United States Patent [19]

Cotic et al.

[11] Patent Number: 5,038,914

[45] Date of Patent: Aug. 13, 1991

[54] AUTOMATIC TIE PLATE SORTING CONVEYOR

[75] Inventors: Dennis J. Cotic, Waukesha; John L. Thorson, Wauwatosa, both of Wis.

[73] Assignee: Oak Industries, Inc., Waltham, Mass.

[21] Appl. No.: 604,371

[22] Filed: Oct. 26, 1990

Related U.S. Application Data

[60] Continuation of Ser. No. 423,028, Oct. 18, 1989, abandoned, which is a division of Ser. No. 203,486, Jun. 7, 1988, Pat. No. 4,909,375.

[51] Int. Cl.[5] ..... B65G 17/32

[52] U.S. Cl. ..... 198/393; 198/397; 198/690.2; 198/853

[58] Field of Search ..... 198/688.1, 698, 690.2, 198/699, 853, 851, 393, 397

[56] References Cited

U.S. PATENT DOCUMENTS

| | | | |
|---|---|---|---|
| 726,257 | 4/1903 | Colahan | 198/699 |
| 1,638,267 | 8/1927 | Morehead et al. | 198/698 X |
| 2,290,456 | 7/1942 | Stilwell | 198/698 X |
| 2,466,240 | 4/1949 | Joa | 198/698 X |
| 2,796,972 | 6/1957 | Jeffras, Sr. | 198/698 |
| 3,157,271 | 11/1964 | Peterson | 198/393 |
| 3,981,390 | 9/1976 | Richard | 198/690.2 |
| 4,042,098 | 8/1977 | D'Agnolo et al. | 198/393 |
| 4,351,429 | 9/1982 | Garvey | 198/690.2 |
| 4,582,193 | 4/1986 | Larsson | 198/853 X |
| 4,629,063 | 12/1986 | Hodlewsky et al. | 198/690.2 X |
| 4,735,343 | 4/1988 | Herzog | 198/393 X |

FOREIGN PATENT DOCUMENTS

| | | | |
|---|---|---|---|
| 2805927 | 8/1979 | Fed. Rep. of Germany | 198/698 |
| 330085 | 9/1972 | U.S.S.R. | 198/393 |

*Primary Examiner*—D. Glenn Dayoan

*Attorney, Agent, or Firm*—Welsh & Katz, Ltd.

[57] ABSTRACT

A sorting conveyor for rail tie plates or the like including an inclined frame having an upper end and a lower end, and an endless conveyor belt formed of a plurality of links pivotally joined to each other. The links are designed to have plate retaining pockets formed thereon and the belt is adapted to travel a contoured path on the frame between the lower end and the upper end. The belt has an upper working strand and a lower slack strand. A hopper provides a supply of randomly oriented tie plates to the lower end of the conveyor which are agitated or tumbled by the action of the moving conveyor belt. At least one rejecter hook is provided to ensure proper positioning of the plates within the pocket. As the conveyor belt progresses towards the upper end of the frame, certain plates are oriented properly within the plate pockets and will be conveyed to the upper end of the frame through the movement of the conveyor belt. Plates which are not properly oriented are rejected from the conveyor belt by the rejecter hook which flings the plates back to the lower end of the conveyor for eventual proper placement within the pockets.

6 Claims, 1 Drawing Sheet

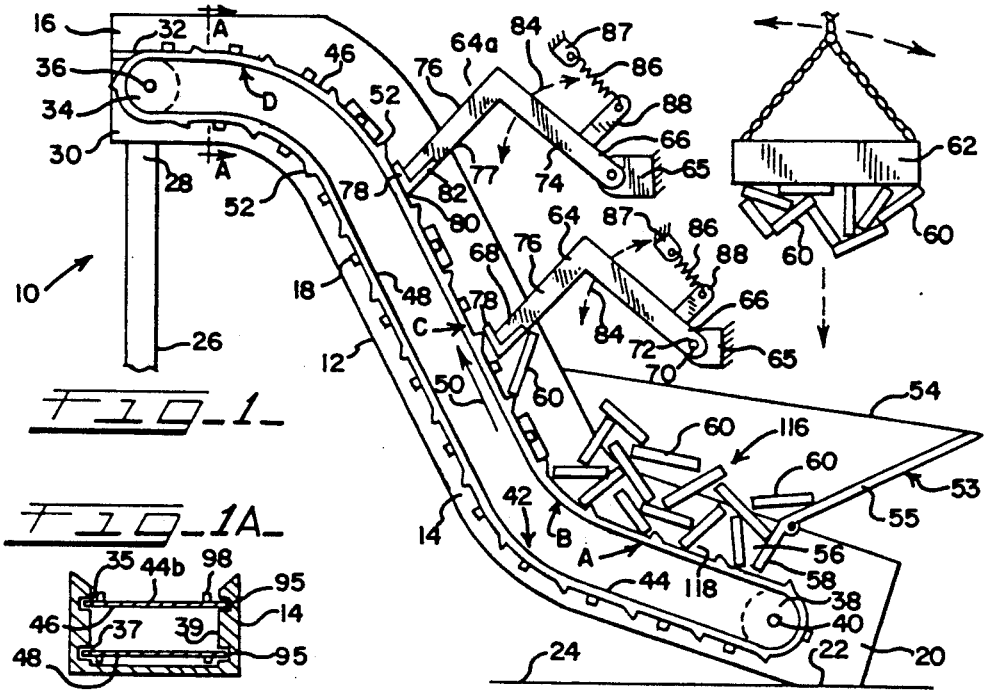
FIG. 1
FIG. 1A
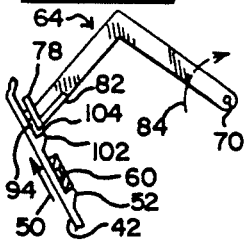
FIG. 2A
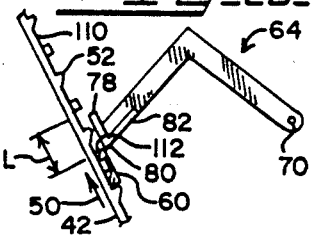
FIG. 2B
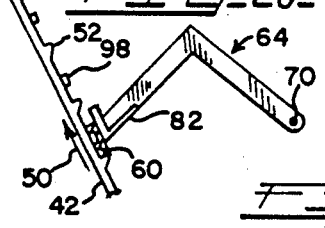
FIG. 2C
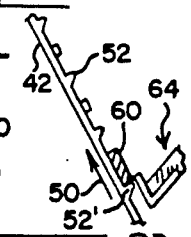
FIG. 2D
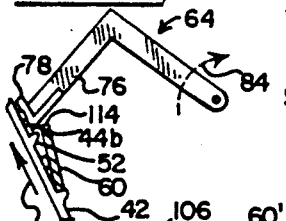
FIG. 3A
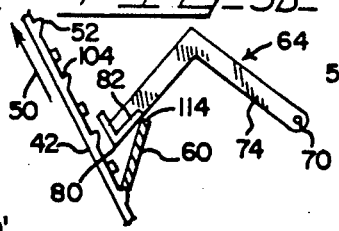
FIG. 3B
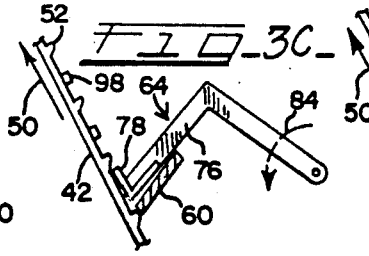
FIG. 3C
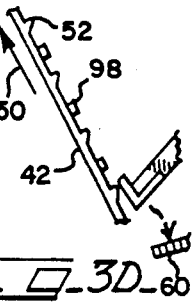
FIG. 3D
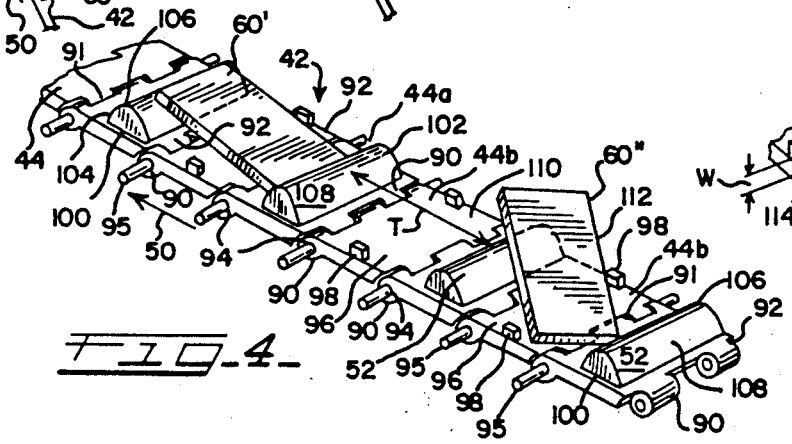
FIG. 4
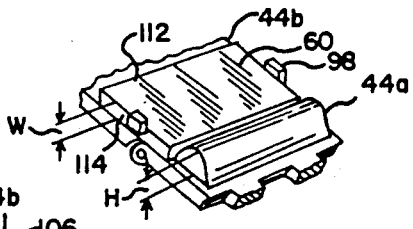
FIG. 5

AUTOMATIC TIE PLATE SORTING CONVEYOR

RELATED APPLICATIONS

This application is a continuation of Ser. No. 423,028, filed Oct. 18, 1989, titled "Automatic Tie Plate Sorting Conveyor", now abandoned, which was a division of Ser. No. 203,486 filed June 7, 1988, titled "Automatic Tie Plate Sorting Conveyor", now U.S. Pat. No. 4,909,375.

BACKGROUND OF THE INVENTION

The present invention relates to machines for repairing or reconditioning railroad rights-of-way and more specifically relates to a conveyor apparatus for orienting randomly stored rail tie plates in a desired length-to-width position and for transporting the oriented plates for subsequent further handling prior to placement of the plates upon railroad ties.

The invention disclosed in the present application is related to the invention disclosed in co-pending application Ser. No. 203,328, filed June 7, 1988, titled "Method and Apparatus for Automatically Setting Rail Tie Plates", now U.S. Pat. No. 4,942,822, as well as co-pending application Ser. No. 226,761, filed Aug. 1, 1988 titled "Automatic Tie Plate Setting Machine", now U.S. Pat. No. 4,974,518.

Tie plates are used to secure rails to railroad ties and comprise a generally flat steel plate with a substantially flat bottom, a plurality of spike holes located on opposite side ends of the plate, and an upper surface having a pair of parallel, vertically projecting rail securing ribs which define a rail seat therebetween. The tie plate upper surface is slightly angled to provide an inwardly canted rail seat, with more mass located on the field side of the plate to compensate for the force distribution of trains negotiating curves at high speed.

In the process of reconditioning railroad rights-of-way, the existing rail is removed along with the spikes and tie plates, the ties are replaced or resurfaced, and the track bed is refurbished. Before new rails are laid, replacement or recycled tie plates must be accurately positioned upon the ties.

Tie plate replacement is a cumbersome and labor-intensive operation, due to the significant weight of the individual plates (18–40 lbs. each) and the rapid rate at which they must be positioned to keep up with the other operations of track reconditioning, most of which are largely automated. Normally a member of a plate handling crew must retrieve steel plates individually from an often tangled pile and properly orient each plate for setting upon the upper surface of a tie to form new track beds. Two hands are required to position each plate due to their size and significant weight. If the plate is inverted, a worker must get his fingers under the plate and turn it over. Typically this is done on the ground or on a steel table surrounded by other plates and track material. Accurate plate placement is critical, for the plates are required to be positioned within ¼ inch on an imaginary x-y plane parallel to the ground. It has been estimated that a member of a plate feeding crew will handle 150,000 pounds per 8 hour shift. In order for the manual plate setting operation to keep up with the other automated track reconditioning operations of the rail gang, the workers must lay plates at 30 to 40 plates per minute for maximum rail gang efficiency. Considering the relatively rapid rates of placement required, as well as the degree of accuracy required, operator effort and safety become major concerns.

Previous attempts at automating the tie plate setting operation resulted in devices largely concerned with the actual placement of the plate on the ties. These prior art setters depended on a supply of plates which had already been manually oriented, either on or off-site. On-site, plates are often prepositioned along the shoulder of the track bed, or carried in a gondola to be fed via conveyors to the plate setting device. However, the rapid rate of 30 to 40 plates per minute at which automatic tie plate setters must operate to keep up with other automated track maintenance equipment requires extensive preplacement and manual handling and sorting of plates.

Accordingly, the automatic tie plate sorting conveyor of the invention is designed to receive randomly oriented tie plates and to orient them in proper length-to-width position for subsequent mechanical handling and eventual placement upon the rail tie. The machine is designed to accommodate a large variety of tie plate size configurations and may be integrated with a larger plate handling device traveling at a constant speed over the rail bed.

SUMMARY OF THE INVENTION

A sorting conveyor for rail tie plates for a railroad track is designed to receive a supply of randomly-oriented rail tie plates, to orient them in proper length-to-width position, and to convey the oriented plates to an appropriate plate handling device for further orientation and eventual placement upon the upper surfaces of railroad ties.

More specifically, the conveyor includes a frame having an upper end and a lower end, and an endless conveyor belt formed of a plurality of links, each link being pivotally joined to adjacent links, and the links having formations thereon designed to form plate retaining pockets. Each pocket is dimensioned to accommodate only one tie plate in proper length-to-width orientation for placement. The conveyor belt is adapted to travel a contoured path upon the frame between the lower and upper ends of the frame. A hopper is provided at the lower end of the frame in communication with the conveyor belt and is designed to retain a supply of randomly oriented tie plates and to supply the plates to the lower end of the conveyor. As the conveyor belt moves beneath the stored plates, it provides an agitating force which causes certain of the plates to be wholly retained in the pockets of the moving belt in proper length-to-width orientation for placement upon the ties. Whether the plates in the pockets are inverted or right side up will not interfere with their being conveyed by the conveyor of the invention. Other plates will be only partially located within the pockets. At least one rejecter hook is mounted to the frame and positioned above the conveyor belt so as to intercept those plates on the upper or loaded strand of the belt which are not properly oriented within the pockets. When the rejecter hook encounters a misaligned plate, the hook engages the plate and forces it back down to the lower end of the conveyor where it joins the supply of agitated, randomly oriented plates. Through the continuous movement of the conveyor belt and the action of the rejecter hook, the randomly oriented plates in the hopper are realigned so that eventually all of the plates will properly fall into a pocket of the belt for subsequent conveying to the upper end of the conveyor.

BRIEF DESCRIPTION OF THE DRAWINGS

FIG. 1 is a diagrammatic side elevational view of the sorting conveyor for rail tie plates of the invention wherein a side wall has been removed for purposes of explanation;

FIG. 1A is a diagrammatic sectional elevation taken along the line A—A of FIG. 1 and in the direction indicated generally;

FIGS. 2A-2D are diagrammatic fragmentary side elevational views of the conveyor depicted in FIG. 1 and chronologically depict the cycle of operation of a rail tie plate properly oriented upon the conveyor belt;

FIGS. 3A-3D are diagrammatic fragmentary side elevational views of the conveyor depicted in FIG. 1 and chronologically depict the interaction between the rejecter hook and a rail tie plate improperly oriented on the conveyor belt;

FIG. 4 is a perspective elevation of the conveyor belt of the invention depicting tie plates located thereon in misaligned length-to-width orientation; and FIG. 5 is a fragmentary perspective elevation of the conveyor belt as described in FIG. 4 depicting a plate properly oriented thereon.

DESCRIPTION OF THE PREFERRED EMBODIMENT

Referring to the drawings, wherein like reference characters designate like characteristics, FIG. 1 depicts a sorting conveyor for rail tie plates or the like designated generally by the reference numeral 10. The conveyor 10 is designed to be either mounted to a movable frame for independent movement along the rail bed or alternatively may be mounted to a larger rail tie plate orientation machine or other rail right-of-way maintenance machine. The details of the type of machine used to move the conveyor along the track are not pertinent to the operation of the present invention and as such have been omitted herein. The conveyor 10 includes a contoured frame 12 having a pair of sidewalls 14 with a generally 'S'-shaped configuration and including an upper end 16, a central portion 18 and a lower end 20. For purposes of explanation, in FIG. 1 the conveyor 10 is shown with one of the sidewalls removed. The lower end margin 22 of the lower end 20 is adapted to rest upon the substrate 24 which may be a base plate or a portion of the aforementioned machine. A vertical support member 26 is secured at an upper end thereof 28 to the lower edge margin 30 of the upper end 16 of the frame 12. The lower end of the vertical support 26 (not shown) is secured to the substrate 24. The vertical support 26 may consist of a relatively wide beam, a pair of vertical legs or any alternative support means for maintaining the upper end 16 of the frame 12 in an elevated position. A horizontal discharge chute 32 is located at the upper end 16 of the frame 12.

An upper conveyor roll 34 is transversely mounted at the upper end 16 of the frame 12 for axial rotation about an axis represented by the shaft 36 which protrudes from both ends of the roll 34. The upper roll 34 is provided with a conventional power source (not shown) such as a motor of sufficient motive power to drive the loaded conveyor belt as described hereinbelow. In addition, the outer peripheral surface of the drive roll 36 may be provided with teeth or other suitable projections (not shown) designed to drive a conveyor belt. A lower conveyor roll 38 is located at the lower end 20 of the frame 12 in transverse orientation thereto and parallel to the upper roll 34. The lower roll 38 is also designed for axial rotation about an axis represented by the shaft 40 which projects from both ends of the roll 38 and may also be provided with teeth or suitable projections (not shown) designed to engage a conveyor belt. The shafts 36 and 40 are mounted to the sidewalls 14 of the frame 12 and are provided with suitable bearings (not shown). While the upper drive roll 34 is provided with a power source, the lower roll 38 is an idler roll and as such is designed for freewheeling axial rotation between the sidewalls 14.

An endless conveyor belt 42 is mounted around the upper and lower conveyor rolls 34, 38 and is designed to follow the contoured path defined by the sidewalls 14. This path contour includes a lower portion A having a gradual incline, an upwardly curving portion B and a relatively steeply inclined portion C. The inclined portion C leads to the substantially horizontal portion D, which is adjacent the horizontal discharge chute 32. The orientation of the belt 42 within the frame 12 may be maintained by upper and lower recesses or guides 35 and 37 provided on the inner faces 39 of the sidewalls 14 (best seen in FIG. 1A). The recesses 35, 37 are engaged by laterally projecting pins 95 described in greater detail hereinbelow. The belt 42 is made up of a plurality of individual links 44 pivotally joined to each other (best seen in FIG. 4). The belt 42 further includes an upper, working or loaded strand 46 and a lower, slack or unloaded strand 48. The drive roll 34 is designed to move the upper strand 46 of the belt 42 in the direction indicated by the arrow 50. Alternate links 44 of the belt 42 are provided with cleats 52 located on the upper surfaces thereof and transverse to the direction of movement of the conveyor belt 42 indicated by the arrow 50.

A hopper 53 is mounted to the lower end 20 of the frame 12 and includes an enlarged upper opening 54, a funnel shaped portion 55 and a relatively smaller lower opening 56 which is in communication with the upper strand 46 of the belt 42. The hopper 53 includes a lower retaining wall 58 designed and positioned to retain the tie plates and prevent their escape from the upper strand 46 of the belt 42 to the lower end 28 of the frame 12. The hopper 53 is constructed and arranged to retain a plurality of randomly oriented tie plates 60 therein. The tie plates 60 may be loaded into the hopper 53 by means of an industrial or scrap iron type electromagnet 62 which is movable from a position directly above the opening 54 of the hopper 53 to a position (not shown) where a large supply of tie plates 60 may be stored. In that the plates 60 have a conventional configuration as described hereinabove, including a top side with a pair of ribs, a field side, a track side and a plurality of spike holes, for the purposes of the invention, the plates have been depicted as rectangular flat boxes.

At least one rejecter hook 64 is positioned above the upper strand 46 of the belt 42 and is mounted to the frame 12 by suitable support ears or members 65. In the preferred embodiment, two such rejecter hooks 64 are provided. Each hook 64 is an elongate member of substantially 'L'-shaped configuration including a pivot end 66 and a free end 68. The pivot end 66 is provided with a pivot bore 70 which is designed to matingly engage a pin 72 mounted to the support member 65. The pivot end 66 further includes a pivot leg 74 extending therefrom which intersects a free leg 76 on an approximate perpendicular or right angle and is integral therewith. The free leg 76 has a downward facing edge margin 77 and terminates at the free end 68.

A shoe 78 is secured to the free end 68 of the rejecter hook 64 in preferably releasable fashion, such as by tack welding or conventional fasteners (not shown). The shoe 78 is provided with an inclined or tapered leading edge 80. The shoe 78 is preferably manufactured of wear resistant materials such as high carbon steel or carbide impregnated alloys. In addition, a plate rejecter surface 82 fabricated of similar wear resistant material as is the shoe 78 may be provided as an integral portion of the shoe 78 designed to be secured to the edge margin 77. Alternatively, the rejecter surface 82 may be an individual component replaceable separately from the shoe 78. The rejecter surface 82 is designed to have a length at least as long as the longest tie plate 60.

The rejecter hooks 64 are adapted to pivot about the pivot pin 72 and travel a substantially vertical pivot arc designated by the reference numeral 84. A biasing force is provided to bias the rejecter hooks 64 against the upward motion of the conveyor belt as indicated by the arrow 50. This biasing force may be provided by a coiled tension spring 86 connected at one end to a spring lug 87 on the frame 12 and at the other end to a spring support 88 which is integral with, and projects vertically from the pivot leg 74 of the rejecter hook 64. Contact between the shoe 78 and the upper strand 46 of the conveyor belt 42 is maintained by the gravity weight of the hooks 64 as well as the tension spring 86.

Referring now to FIG. 4, the structural features of the conveyor belt 42 are shown in greater detail. It will be seen that each conveyor link 44 includes a plurality of like link ends 90 at each respective front and rear end margins 91 and 92 thereof. The front and rear end margins 91 and 92 of each link 44 are provided with mating radiused configurations to prevent link grabbing and jamming. The respective link ends 90 of adjacent links 44 are arranged in spaced, staggered relationship to each other to form a piano-hinge type junction. The respective link ends 90 of adjacent links 44 are each provided with an axial bore 94 which is designed to accommodate a pin 95 which passes through the corresponding bores 94 of the adjoining link ends 90 to form a pivot joint. The pins 95 are provided in a long enough length so that the ends thereof project beyond the bores 94 as shown in FIGS. 1A and 4. The ends of the pins 95 engage the upper and lower recesses 35 and 37 to guide the belt 42 in its contoured path defined by the frame 12. Each link 44 includes a heavily-armored planar or pan portion 96 which is bordered by the link ends 90 along each front and rear margin 91, 92 thereof.

The links 44 are alternately provided with a transverse cleat 52. Those links 44 having cleats 52 will be referred to as cleat links **44*a* and those links 44 without cleats will be referred to as pan links 44*b*. Each cleat 52 is provided with an elongate body having a generally planar lower surface 100 and a contoured upper surface 102 including a substantially vertically extending leading edge surface 104, a rounded apex 106 integral with the leading edge surface 104, and a declining portion 108 integral with the apex 106 and having a tapered rear edge. The leading edge surface 104 is slightly curved to facilitate free pivoting action of adjacent links 44. The rounded apex 106 is configured as shown to prevent the edges of improperly oriented tie plates 60 from establishing a hold thereon. Each cleat 52 is releasably secured along its lower surface 100 to the planar pan portion 94 of a cleat link 44*a*** by tack welds or by suitable fasteners such as recessed threaded fasteners (not shown).

The pan links **44*b* are positioned between adjacent cleat links 44*a* so as to define a plate pocket 110. The size of the plate pocket 110 is important to the successful operation of the conveyor 10, for the pockets 110 are dimensioned so that one and only one plate 60 may be properly positioned therein so that the long edges 112 of the plate 60 are directly opposite and in parallel relation to the cleats 52. The plate 60 may be either right side up, with the aforementioned rail securing ribs facing upward, or inverted as it is located in the pocket 110. This orientation of the plate 60 within the pocket 110 (best seen in FIG. 5) will be referred to as proper length-to-width orientation for the operation of the conveyor 10. To encourage the proper orientation of the plates 60 within the pockets 110, the cleats 52 are separated from each other a distance 'T' which is less than the length of a long edge 112 of a plate 60, greater than the length of a short edge 114 of one plate 60 and less than twice the length of short edges 114 of a plate 60, such that a plate 60 may either be located properly in the pocket 10 as shown in FIG. 5 or is forced outward thereof at an angle as shown in FIG. 4 (plates 60' and 60'') When plates 60 of various dimensions are used, the pocket dimension 'T' may be altered by changing the position of the cleats 52, or a substitute belt 42 may be provided having the dimensions of the pocket 110 adjusted accordingly to the dimensions of the particular plates 60**.

Referring to FIG. 5, a second dimensional component of the pocket 110 is the height of the cleats 52, designated by reference character H. The height H is preferably less than twice the height of thickness of the plates 60 indicated by the reference character W, so that only one plate 60 may be properly oriented within the pocket 110. If two plates 60 should be located one directly on top of the other in proper orientation within a pocket 110, the rejecter hooks would remove the upper plate and level it back to the lower end 20 of the conveyor frame 12.

Referring to FIG. 4, the pan links **44*b* may be provided with an upwardly projecting lug 98 positioned at each side end thereof to prevent the lateral misalignment of the plates 60 within the pocket 110 and further to minimize abrasive damage by the plates 60 to the inside faces 39 of the sidewalls 14. The lugs are preferably integral with the link 44*b***.

In operation, the conveyor 10 is fed by dropping a plurality of plates 60 into the hopper 53 by using the industrial electromagnet 62. The plates 60 form a pile 116 within the hopper 53 and on the upper strand 46 of the belt 42 near the lower end 20 of the frame 12. As the belt 42 moves beneath the pile 116, the probability of a plate 60 being initially properly oriented in a pocket 110 is very low. Acceptance of plates 60 within the pockets 110 is greatly increased by continually tumbling the pile 116 by the movement of the belt 42 thereunder, which exposes the plates 60 in the pile 116 to moving plate pockets 110 at a point designated generally by reference numeral 118, where the pile 116 interfaces the belt 42. Plate tumbling is enhanced by the upwardly curved portion B of the belt path. Properly oriented plates 60 travel up the upper strand 46 of the belt 42 to the upper end 16 of the frame 12 for discharge via the discharge chute 32. The center of gravity of an individual plate is toward the upper strand 46 of the conveyor belt 42, and therefore the plates 60 do not fall off the belt.

Referring to FIG. 4, the plates 60' and 60" are shown in misaligned position. Since the position of plates 60' and 60", or of any plates 60 not properly located within the pockets 110 is undesirable, it is important to prevent these misaligned plates from reaching the upper end 16 of the conveyor 10. The function of the rejecter hooks 64 is to prevent misaligned plates 60 from reaching the upper conveyor end 16, while not removing plates which are properly located within the pockets 110. Referring now to FIGS. 2A-2D, the sequence of operation of the conveyor 10 when a plate 60 is properly oriented within the pocket 110 is shown. In FIG. 2A, the plate 60 is moving in the direction indicated by the arrow 50 towards the upper end 16 of the conveyor 10 (best seen in FIG. 1). The rejecter hook 64 is biased to contact the upper strand 46 of the belt 42 and to follow the contour thereof as defined by the planar pan portion 94 and the upper surface 102 of the cleats 52. As the belt 42 moves toward the upper end 16 of the conveyor 10, the shoe 78 will encounter the vertical leading edge surface 104 of the cleat 52. The contour of the upper surface 102 of the cleat 52 will cause the hook 64 to pivot upwardly along the arc indicated by the arrow 84.

Referring to FIG. 2B, the rejecter hook 64 is shown in the elevated position and is impacting both the apex 106 of the cleat 52 and the plate 60 properly located within a pocket 110. The shoe 78 is provided with a length 'L' such that the cleat 52 will support the shoe 78 until the leading edge 80 is past the uppermost edge 112 of the plate 60 so as not to interfere with the position of the plate 60 within the pocket 110. Referring to FIG. 2C, once the belt 42 progresses upwardly so that the cleat 52 is no longer in contact with the shoe 78, the biasing force provided by the spring 86 and the weight of the hook 64 cause the shoe 78 to slidingly engage the plate 60. At this point, the shoe 78 cannot interfere with the position of the plate within the pocket 110 and the shoe 78 merely passes over the plate 60. Referring to FIG. 2D, the plate 60 is shown to have passed beneath the shoe 78, which is now engaged by a second cleat 52'.

Referring now to FIGS. 3A-3D, due to the dimensional configuration of the pockets 110, misaligned plates 60 not properly located within the plate pocket 110 protrude above the cleats 52. Protruding plates 60 are stripped off the upper strand 46 by the rejecter hooks 64. Referring to FIG. 3A, the belt 42 is shown moving towards the upper end 16 of the frame 12 in the direction indicated by the arrow 50, and the shoe 78 of the rejecter hook 64 is shown engaging an empty pan link 44*b* of the belt 42. A plate 60 is shown not properly located within the pocket 110 and projecting above the cleat 52 at one short edge 114 thereof. The inclined leading edge 80 of the shoe 78 is adapted to liftingly engage the elevated end 114 of the plate 60. In addition, the vertical edge surface 104 of the cleat 52 is also dimensioned to encourage the sliding action of the edge 80 thereover and into engagement with the end 114 of the plate 60.

Referring to FIG. 3B, the leading edge 80 of the shoe 78 engages the elevated end 114 of the plate 60 so as to lift the plate 60 out of the pocket 110. The end 114 slides upwardly along the plate rejecter surface 82 with the movement of the belt 42. Referring now to FIG. 3C, the movement of the belt 42 in the direction indicated by the arrow 50, the gravity weight of the rejecter hook 64 and the biasing force exerted on the hook 64 by the spring 86 cause the shoe 78 to exert a greater lifting force, upon the elevated plate 60 so that the plate is substantially aligned in parallel relation to the free leg 76 of the rejecter hook 64. Referring to FIG. 3D, as the conveyor belt 42 moves in the upward direction indicated by the arrow 50, the plate 60 moves against the force exerted by the rejecter hook 64 until the plate is rejected from the upper strand 46 of the belt 42 and is returned to the pile 116 of plates 60 located at the lower end 20 of the conveyor frame 12. The steeply inclined configuration of portion C of the conveyor belt path facilitates the return fall of rejected plates to the pile 116.

Consequently, plates 60 properly oriented within the pockets 110 as shown in FIGS. 2A-2D will be conveyed by the conveyor belt 42 to the upper end 16 of the frame 12 to be deposited upon a subsequent plate handling apparatus designed to place the plates in proper orientation for placement upon the rail ties. Those plates 60 which are improperly oriented within the pockets 110 will be engaged by the shoes 78 and the rejecter surfaces 82 and rejected from the pockets 110 by the rejecter hooks 64 and returned to the tumbling pile 116 located at the lower end 20 of the frame 12. The present conveyor is designed to accommodate a plate placement rate of approximately 25-40 plates per minute properly oriented within the pockets 110 and delivered to the upper end 16 of the frame 12. To achieve this rate, it is preferred that a second rejecter hook 64*a* be provided and positioned as shown in FIG. 1 to catch or to reject any plates missed by the first rejecter hook 64. It will be appreciated that additional hooks 64 may be added as needed in certain applications.

While particular embodiments of this apparatus have been described, it will be obvious to a person skilled in the art that changes and modifications might be made without departing from the invention in its broader aspects.

What is claimed is:

1. A link for a conveyor belt in a sorting conveyor for rail tie plates, the belt being configured to receive randomly arrayed tie plates from a hopper and to properly align the plates in a specified length-to-width orientation, each plate having a pair of long edges and a thickness, said link comprising:

a first plurality of link ends, each said link end formed to circumscribe a pivotal bore, said bores of said first plurality being arranged coaxially;

a second plurality of link ends, each said link end formed to circumscribe a pivotal bore, said bores of said second plurality being arranged coaxially;

a generally planar pan surface having a first edge margin and a second edge margin, said first edge margin having said first plurality of link ends integral therewith, said second edge margin having said second plurality of link ends integral therewith; and an elongate, vertically projecting cleat mounted upon said pan surface in substantially parallel relation to said first and second edge margins, said cleat including an elongate solid body having a generally planar lower surface and an upper surface including a first substantially vertically protruding, slightly curved leading edge surface, a rounded apex integral with said leading edge surface, said rounded apex configuration adapted to prevent one or more of the tie plates from establishing a hold thereon, and a declining portion integral with said apex, said declining portion having a tapered following edge, said cleat being disposed upon said pan surface to partially define a pocket for, and being configured to accommodate, a single properly aligned rail tie plate, said cleat being positioned to be generally parallel to one of the long tie plate edges, and having a height being less than twice the tie plate thickness.

2. The conveyor link described in claim 1 wherein said cleat is releasably attached to said pan surface.

3. A linked belt for an orienting conveyor designed to receive randomly arrayed rail tie plates from a hopper and to convey the rail tie plates in aligned length-to-width orientation, the tie plates each having a pair of long edges, a pair of short edges and a thickness, the belt comprising in combination:

a plurality of generally planar links including a pan surface having first and second edge margins, said edge margins each having a respective plurality of coaxially-aligned link ends integral therewith;

a plurality of cleated links, said cleated links each including a generally planar upper surface with an elongate, contoured cleat secured thereon, said planar surface having first and second edge margins, each said cleat being generally parallel to said edge margins and said edge margins each having a respective plurality of coaxially-aligned link ends integral therewith;

said pluralities of planar and cleated links being arranged so that said link ends of each planar and cleated link are releasably engaged between, and coaxial with, said link ends of an adjacent link, said planar links and said cleated links being arranged to define a plurality of pockets, each said pocket dimensioned so that a distance between adjacent cleats is less than the long edge of the tie plate and greater than the tie plate short edge, and the height of the cleats is on the order of less than twice the tie plate thickness so as to accommodate only one properly aligned rail tie plate therein, each said pocket being configured so that said cleats are generally parallel to the long edges of properly aligned tie plates;

each of said cleats including an elongate solid body having a generally planar lower surface and an upper surface including a first substantially vertically protruding leading edge surface, a rounded apex integral with said leading edge surface, said rounded apex configuration adapted to prevent one or more of the tie plates from establishing a hold thereon, and a declining portion integral with said apex, said declining portion having a tapered following edge; and means for pivotally connecting said links at engaged link ends to form said belt.

4. The belt as defined in claim 3 further including means for preventing lateral misalignment of the plates within said pocket.

5. The belt as defined in claim 4 wherein said means for preventing lateral misalignment includes an upwardly projecting lug located on each side of each of said planar links.

6. A linked belt for an orienting conveyor designed to receive randomly arrayed rail tie plates from a hopper and to convey the rail tie plates in aligned length-to-width orientation, the tie plates each having a pair of long edges, a pair of short edges and a thickness, the belt comprising in combination:

a plurality of generally planar links including a pan surface having first and second edge margins, said edge margins each having a respective plurality of coaxially-aligned link ends integral therewith;

a plurality of cleated links, said cleated links including a generally planar upper surface with an elongate, contoured cleat secured thereon, said planar surface having first and second edge margins, said cleat being generally parallel to said edge margins and said edge margins each having a respective plurality of coaxially-aligned link ends integral therewith;

said pluralities of planar and cleated links being arranged so that said link ends of each planar and cleated link are releasably engaged between, and coaxial with, said link ends of an adjacent link, said planar links and said cleated links being arranged to define a plurality of pockets, each said pocket dimensioned so that a distance between adjacent cleats is less than the long edge of the tie plate and greater than the tie plate short edge, and the height of the cleats is on the order of less than twice the tie plate thickness so as to accommodate only one properly aligned rail tie plate therein;

means for pivotally connecting said links at engaged link ends to form said belt; and means for preventing lateral misalignment of the plates within said pocket, said means for preventing including an upwardly projecting lug located on each side of each of said planar links.

* * * * *